US008813761B2

(12) United States Patent
Guliker

(10) Patent No.: US 8,813,761 B2
(45) Date of Patent: Aug. 26, 2014

(54) HAIR PIECE PROVIDED WITH A WAVE-FORM WEAVING BAND

(75) Inventor: Richard Guliker, Rotterdam (NL)

(73) Assignee: Euro Hair R&D B.V., Ea-Schipluiden (NL)

( * ) Notice: Subject to any disclaimer, the term of this patent is extended or adjusted under 35 U.S.C. 154(b) by 618 days.

(21) Appl. No.: 12/524,857

(22) PCT Filed: Jan. 28, 2008

(86) PCT No.: PCT/NL2008/000028

§ 371 (c)(1), (2), (4) Date: Mar. 4, 2010

(87) PCT Pub. No.: WO2008/094031

PCT Pub. Date: Aug. 7, 2008

(65) Prior Publication Data

US 2010/0212680 A1 Aug. 26, 2010

(30) Foreign Application Priority Data

Jan. 29, 2007 (NL) ..... 1033299

(51) Int. Cl.
*A41G 5/00* (2006.01)
*A41G 3/00* (2006.01)

(52) U.S. Cl.
CPC ..... *A41G 5/004* (2013.01); *A41G 5/0073* (2013.01); *A41G 5/00* (2013.01); *A41G 3/00* (2013.01)
USPC ..... 132/53

(58) Field of Classification Search
USPC ..... 132/53–56, 57.1, 58–60, 200, 201; 434/94
IPC ..... A41G 3/00,5/00
See application file for complete search history.

(56) References Cited

U.S. PATENT DOCUMENTS

| | | | | |
|---|---|---|---|---|
| 3,280,826 | A * | 10/1966 | Jenkins | 132/201 |
| 4,799,502 | A * | 1/1989 | Kobayashi et al. | 132/53 |
| 6,629,536 | B1 * | 10/2003 | Lane | 132/53 |
| 6,830,054 | B1 * | 12/2004 | Ross-Kuehn | 132/201 |
| 2004/0168696 | A1 * | 9/2004 | Cox | 132/54 |
| 2005/0061346 | A1 * | 3/2005 | Song | 132/201 |
| 2007/0125399 | A1 * | 6/2007 | Guliker | 132/201 |
| 2008/0257369 | A1 * | 10/2008 | Poole | 132/53 |
| 2008/0276949 | A1 * | 11/2008 | Lee | 132/53 |

(Continued)

FOREIGN PATENT DOCUMENTS

| | | |
|---|---|---|
| DE | 201 07 344 U1 | 9/2001 |
| FR | 2 897 241 A | 8/2007 |

(Continued)

*Primary Examiner* — Robyn Doan
*Assistant Examiner* — Tatiana Nobrega
(74) *Attorney, Agent, or Firm* — Knobbe, Martens, Olson & Bear LLP

(57) ABSTRACT

Hair piece (1) for connection with basic hair (11) comprising at least one thin, broad hair bundle (10) consisting of a number of parallelly oriented hairs (20), a weaving band (2) made from hair or another suitable material the weaving band (2) being interconnected with an outer end of the hair bundle (11), whereby the weaving band (2) is provided with a—zig-zag, staggered running—wave-form as a result of which the weaving band (2) comprises band crests 4 and band troughs (5), and the weaving band (2) is further provided with support elements (12) for maintaining the wave-form of the weaving band.

10 Claims, 4 Drawing Sheets

(56) References Cited

U.S. PATENT DOCUMENTS

| | | | | |
|---|---|---|---|---|
| 2009/0165810 | A1* | 7/2009 | Sotokawa et al. | 132/54 |
| 2011/0005544 | A1* | 1/2011 | Lane | 132/201 |
| 2011/0247643 | A1* | 10/2011 | Tokko | 132/201 |
| 2011/0253165 | A1* | 10/2011 | Kenna | 132/273 |

FOREIGN PATENT DOCUMENTS

| | | | | |
|---|---|---|---|---|
| FR | 2897241 | * | 8/2007 | A41G 3/00 |
| WO | WO 2005/044031 | | 5/2005 | |
| WO | WO 2005044031 A1 | * | 5/2005 | A41G 3/00 |

* cited by examiner

HAIR PIECE PROVIDED WITH A WAVE-FORM WEAVING BAND

The invention relates to a hair piece for connection with basic hair comprising at least one thin, broad hair bundle consisting of a number of parallelly oriented hairs and a weaving band made from hair or another suitable material like cotton or a synthetic material, the weaving band being interconnected with an outer end of the hair bundle.

Such a hair piece is known from Dutch Patent nr. 1024734 of the applicant. This hair piece is provided with connection openings between two weaving bands of two hair bundles en may be reliable and quickly attached into the basic hair, whereby the weaving band and the knots of basic hair connected therewith are hardly visible because—after attachment of the hair piece into the basic hair—the second hair bundle is folded up over the first hair bundle whereby the knots of basic hair and the hair connection means are hidden from view.

This hair piece with weaving band know per se has the disadvantage that a straight hair line is formed; that the flat hair bundle increases the hair volume only to a little extend and that the integrating and mixing of the hairs of the bundle with the basic hair is not optimal. Furthermore there is a need for increasing the amount of hairs in the hair bundles. After the attachment of the known hair piece nearby the parting in the basic hair, outgrow of the basic hair with the attached hair piece will be quickly visible nearby the parting. Furthermore the weaving band of the know hair piece has the tendency to move away from the head skin thereby decreasing the natural integration with the basic hair.

The object of the invention is to provide a hair piece that is easily, reliably and fastly connectable with basic hair, whereby the weaving band and the knots of basic hair are hardly visible, and whereby the integration and mixing of basic hair with the hair piece is improved, so that the volume of the basic hair is increased and appears to have a softer hair line.

According to the invention the hair piece for connection with basic hair comprises the following elements:

- the weaving band is provided with a—zigzag, staggered running—wave-form as a result of which the weaving band comprises band crests and band troughs,
- the weaving band is further provided with support elements for maintaining the wave-form of the weaving band.

By providing the weaving band with a—zigzag, staggered running—wave-form the hair bundle allows for an increase of the amount of hairs and will impart a greater volume to the basic hair, and the hair connected to this weaving band will form a softer hair line at its free bottom end resulting in a more natural effect with respect to the hair line of a straight hair piece.

In particular the support elements are chosen from the list: rigid or shape-retaining element; bridge element provided between the band crests and/or band troughs of the wave-form weaving band. By providing the wave-form weaving band with a shape-retaining element the wave-form is maintained and retained better after its attachment in the basic hair. Alternatively the wave-form may also be easily fixed and retained by mutually interconnecting the crests and/or the troughs of the weaving band.

In a preferred embodiment a number of bridge elements form an—essentially one piece—second weaving band. In this embodiment the wave-form of the weaving band is fixed by means of a simple and easily manufactured construction and also an additional hair bundle is connected to the second weaving band.

In particular in use in the basic hair the band crests of the wave-form weaving band are tilted towards the basic hair. As a result an improved fit or alignment is obtained between the weaving band and the basic hair so that the hair parting will remain covered, in spite of the outgrow of the basic hair.

Preferably the bridge elements of the second weaving band are/is interconnected with the first weaving band in the neighbourhood of the band troughs. By mounting the support elements to the band troughs of the wave-form weaving band the crests are allowed to tilt towards the basic hair so that integration and mixing with the basic hair is improved and during the outgrow of the basic hair the hair parting will be longer covered.

In an advantageous embodiment of the invention the hair piece is provided with a second hair bundle with its outer end being connected to a third weaving band. As a result a hair piece with a higher volume is obtained giving an enhanced volume effect to the basic hair. Furthermore the hair piece may be easily attached and folded over, while at the same time the advantages of an upper wave-form weaving band remain intact.

Preferably connection openings are provided between the third weaving band and the first and/or the second weaving band. Particularly with their upper sides—the sides opposite of the hair bundle—the third weaving band and the first and/or the second weaving band are transversely interconnected at regular mutual distance by means of connection elements. More in particular the upper sides of the third weaving band and the first and/or second weaving band are transversely adjacently abuttingly positioned with respect to each other. By these features the hair piece is easily attached by folding it open before its attachment into the basic hair and subsequently easily folded up. Moreover the hair piece is better camouflaged or concealed in the basic hair.

In a special embodiment the hair piece is provided with mounting means. With these means the hair piece is easily attached into the basic hair and removed there from e.g. for repositioning due to outgrow of the basic hair.

Preferably the mounting means are provided upon a weaving band positioned on a mounting opening formed between two connection elements. Advantageously, when the hair piece is attached into the basic hair by folding the first hair bundle with weaving band over the second hair bundle with weaving band, the mountings means will thereby be positioned in the neighborhood of the (connection) openings between the weaving bands so that local thickening is prevented in the hair piece at the position of the mounting means.

Alternatively the hair piece according to the invention is obtained by the connection elements being connected to the first or the second weaving band in the neighbourhood of the band troughs of the first wave-form weaving band. As a result the mounting means are hidden from view under the first and/or the second weaving band of the hair piece.

In particular the mounting means are chosen from the list: hair clip, hair pin, hair clamp, adhesion piece.

In an alternative embodiment the first and/or the second and/or the third weaving band at regular mutual distance is/are provided with dividing zones like stitched seams or knot elements, so that the hair piece may be shortened or divided within the dividing zones such that the hair pieces obtained after the division won't fray or otherwise be or become unusable. Advantageously the hair piece may be shortened by cutting the weaving band within a dividing zone between the (stitched seam) elements so that a hair piece (portion) is obtained which wont fray or has unwanted open hanging parts.

Preferably the dividing zones are positioned in the neighbourhood of the band troughs of the first weaving band. By these measure the two hair pieces are provided with a neat, clean exterior without crests of the wave-form weaving bands hanging loose.

The invention also relates to a hair piece for connection with basic hair comprising:

two thin, broad hair bundles consisting of a number of parallelly oriented hairs, two weaving bands made from hair or another suitable material like cotton or a synthetic material, the weaving band being interconnected with an outer end of the hair bundle, whereby the weaving bands are interconnected with their upper sides, in other words, with the sides opposite of the hair bundle, by means of connection elements provided transversely at a regular distance, such that connection openings are configured between the weaving bands, and whereby a weaving band is provided with mounting means between two connection elements forming the connection openings.

The invention will now be described by means of an embodiment shown in the drawing.

Figure 1:
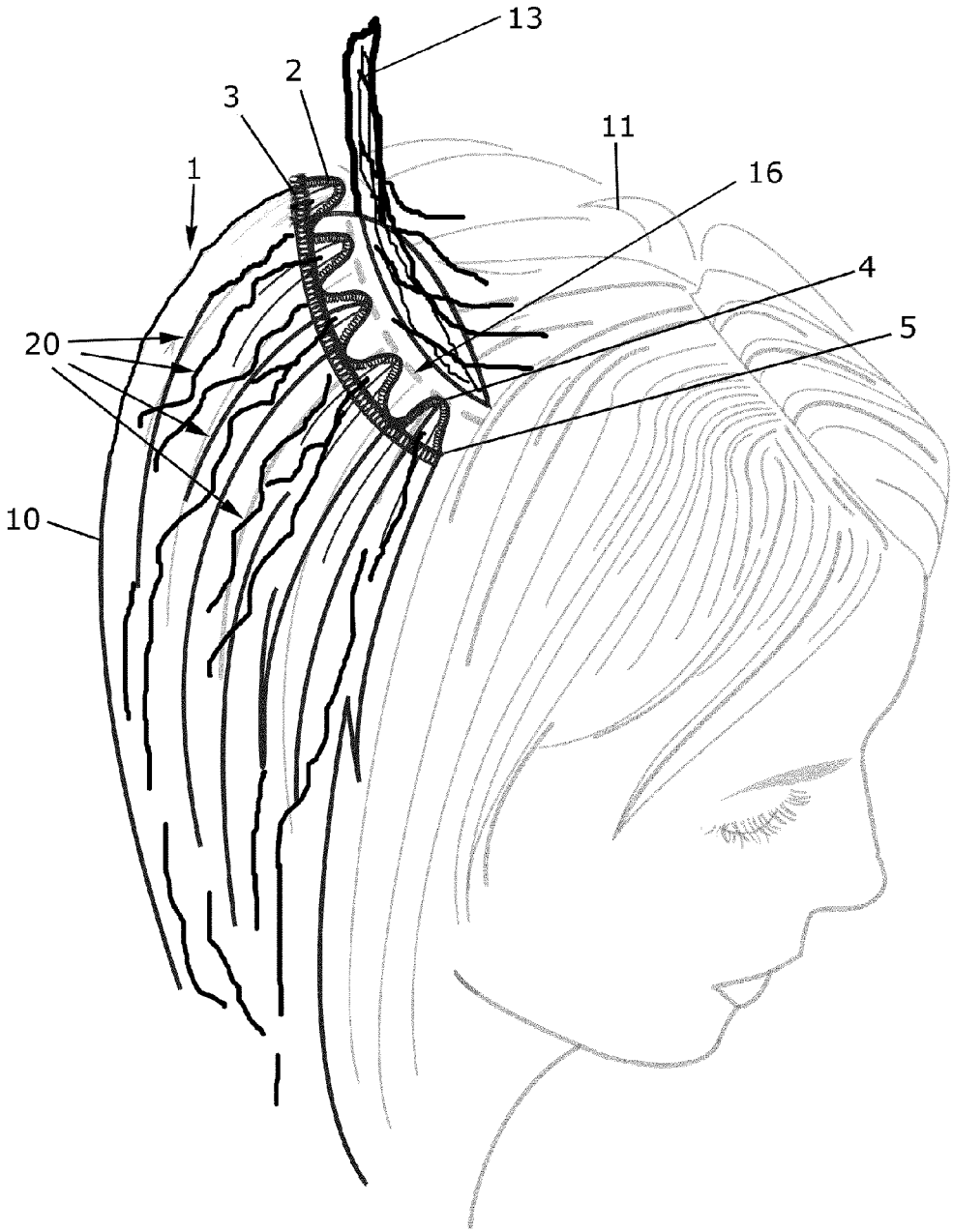
FIG. 1 shows the back of the head of a person with a hair piece attached into the basic hair according to the invention.

In FIG. 1 is shown how hair piece 1 according to the invention is attached into basic hair 11 of the hair(do) of a person, in order to supplement or fill up the basic hair with the hair bundle 10 and provide for more hair volume and a voluminous hairstyle. The hair piece 1 is provided with a hair bundle 10 comprising a number of parallelly oriented hairs 20. The weaving band 2 is preferably made or woven from a flexible thread material like cotton or synthetic yarn. The hair bundle 10 is connected with this weaving band 2 e.g. by means of weaving elements 17 (see FIG. 2) whereto hairs are knotted or attached. This weaving band 2 is provided with a—zigzag, staggered running—wave-form as a result of which this weaving band 2 comprises band crests 4 en band troughs 5. The hair piece 10 of FIG. 1 is provided with a—optional—second weaving band 3, which is connected with the troughs 5 of first weaving band 2. The hair piece is attached into the basic hair 11 by firstly lifting a lock of hair 13, so that a hair parting 16 will be become visible. Subsequently the hair piece 1 is attached into the basic hair in such a way that the band crests 4 are positioned in the neighbourhood of or even upon the hair parting 16. After the attachment into the basic hair 11 the lock of basic hair 13 is repositioned over the hair piece 1, so that the upper side of the hair piece with weaving bands 2, 3 are hidden from view. The hairs 20 constitute a wave-form hairline caused by their connection to the wave-form weaving band, achieving an improved natural mixing with the basic hair 11. With respect to the known per se straight hairline disclosed in NL102473 resulting from the straight weaving band comprising equally long hairs 20, the bottom side of the hair bundle 10 attached to the weaving band will constitute a natural waving hairline which will naturally integrate and mix with the outer ends of the basic hairs.

Figure 2:
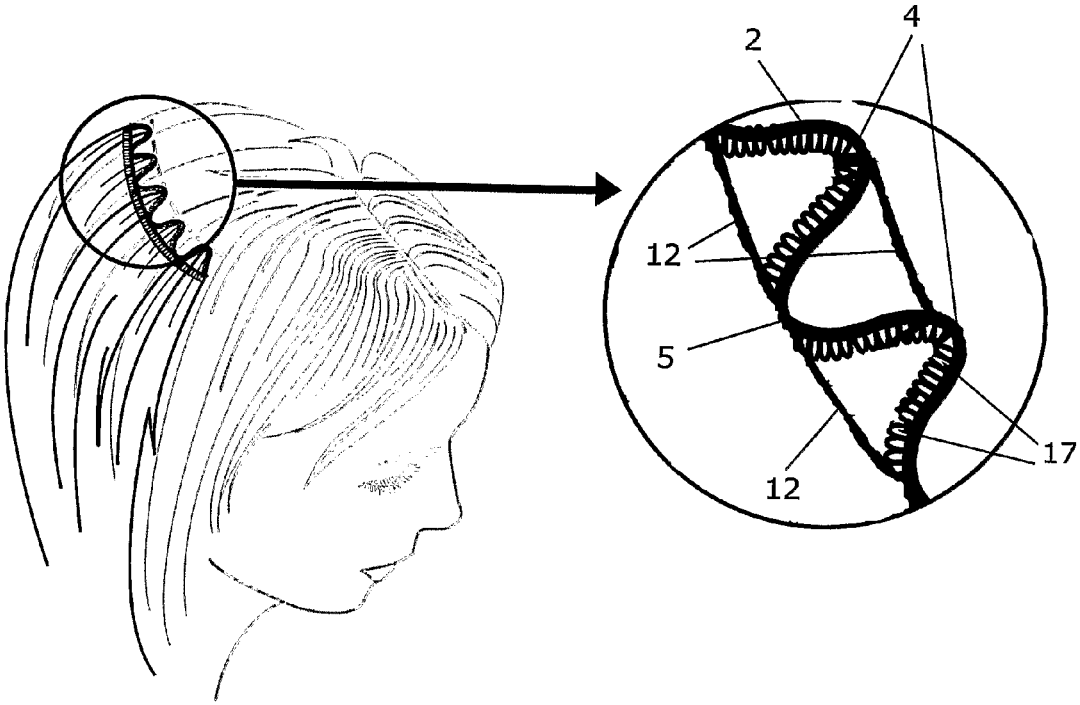
FIG. 2 shows in detail the wave-form weaving band with support elements.

FIG. 2 shows in more detail how the waving weaving band 2 is constructed. In order to maintain and retain the waving shape of the first weaving band 2 support elements are provided. In this embodiment both the crests 4 and the band troughs 5 are provided with support elements 12. In an alternative embodiment the weaving band obtains and retains its zigzag-form by providing a rigid or shape-retaining element in or under the weaving elements 17 of the weaving band 2. It is an essential aspect of the invention that the weaving band and the thereto connected hair 20 comprises a—zigzag, staggered running—wave-form shape creating a softer hairline allowing for more hairs to be included in the hair piece, so that the hair piece is more voluminous. It is clear that within the scope of the current invention other alternative methods may be used to provide a hair piece 10 with an upper side having a wave-form. Therefore all technical equivalents known to a person skilled in the art are also considered to be part of the inventive idea.

Figure 3:
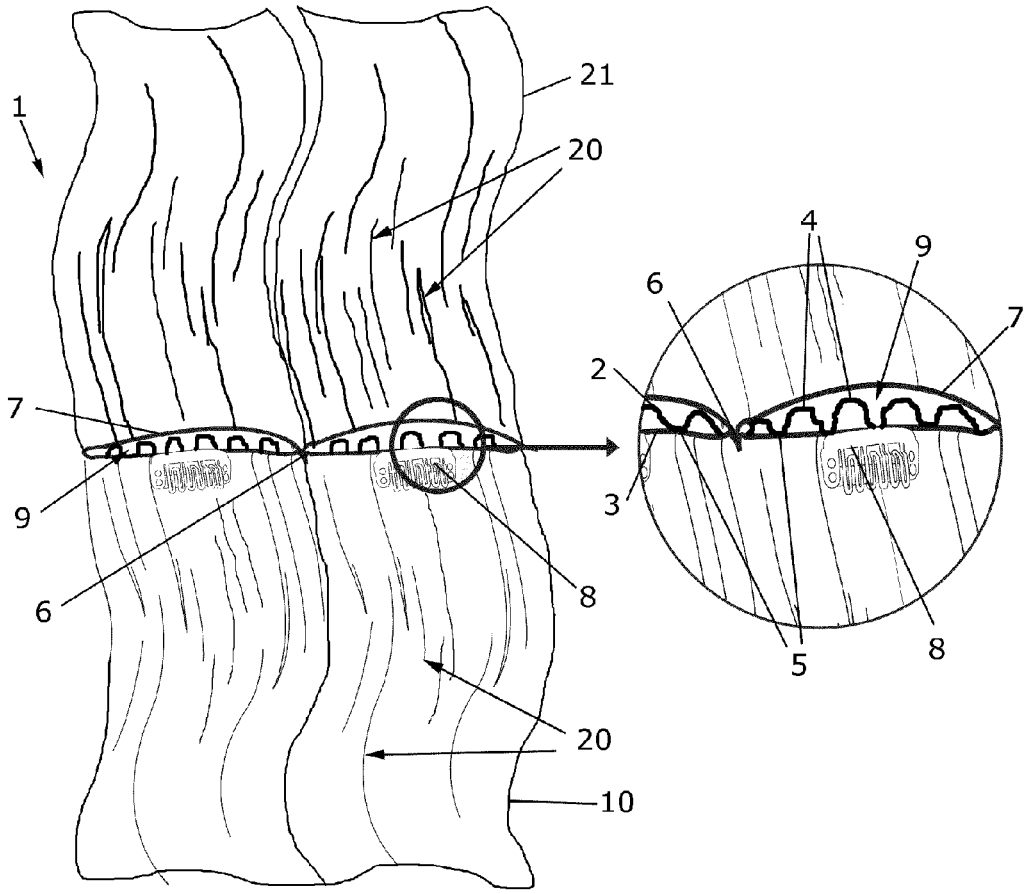
FIG. 3 shows a view of an alternative embodiment of the hair piece according to the invention.

FIG. 3 shows an alternative embodiment of the hair piece 1 according to the invention. The hair piece is provided with a first hair bundle 10 comprising a wave-form weaving band 2, a second weaving band 3 and hairs 20 connected with these weaving bands. Furthermore the hair piece 1 is provided with a second hair bundle 21 comprising a third weaving band 7 having hairs 20 connected therewith. The first hair bundle 10 and the second hair bundle 21 are mutually interconnected by means of connection elements 6, preferably in such a way that the adjacent upper sides of the third weaving band 7 and the first and/or second weaving band 2, 3 are transversely abuttingly positioned. Preferably these connection elements 6 are connection cords positioned at regular mutual distance between the weaving bands of both hair bundles 10, 21. As a result (connection) openings 9 are configured between the weaving bands of both hair bundles. These connection openings 9 may be used to conduct through (to be interconnected) knots of basic hair in order to attach the hair piece in the basic air. Alternatively the knots of conducted through basic hair may be connected to a weaving band and/or a hair bundle 10. It is also possible to conduct knots of basic hair through opening 9 to improve mixing between the hair piece 1 and the basic hair, without interconnecting these knots with the hair piece. When the hair piece is fixedly connected with the basic hair the second hair bundle 21 may be folded up over the first hair bundle 10 so that the weaving band(s) of the first hair bundle 10 and optionally connected knots basic hair are hidden from view. Preferably the outer sides—located on the opposite side of the weaving bands 3, 7 with respect to the head,—in closed position during use—in other words while being wearied in the basic hair—are provided with hair 20, thereby camouflaging the weaving bands. In a special embodiment of the hair piece of FIG. 3 the weaving band is provided with mounting means 8.

In FIG. 3 is shown that the mounting means 8 are positioned upon the second weaving band 3 but if desired the mounting means may also be mounted on another location of the hair piece 1. In the preferred embodiment of FIG. 3 the mounting means 8 are repeatedly provided upon the second weaving band 3 between two connection elements 6 by positioning the upper sides of the mounting means 8 at the same level as the upper side of the second weaving band 3. When the mounting means 8 are attached in this way the (connection) opening 9 between both hair bundles 10, 21 will be positioned (the hair piece being in folded up use position) in the vicinity of the mounting means 8 so that thickening of the hair piece at the location of the mounting means is reduced or completely prevented. As a result the wearing comfort for the user is increased and the hair piece will be more concealed. It is also possible to manufacture the hair piece 10 of FIG. 3 without the first waving weaving band 2. The mounting means 8 in FIG. 3 is a hair clip but every other well known mounting means, like a hair pin, hair clamp of adhesion piece may be applied.

Figure 4:
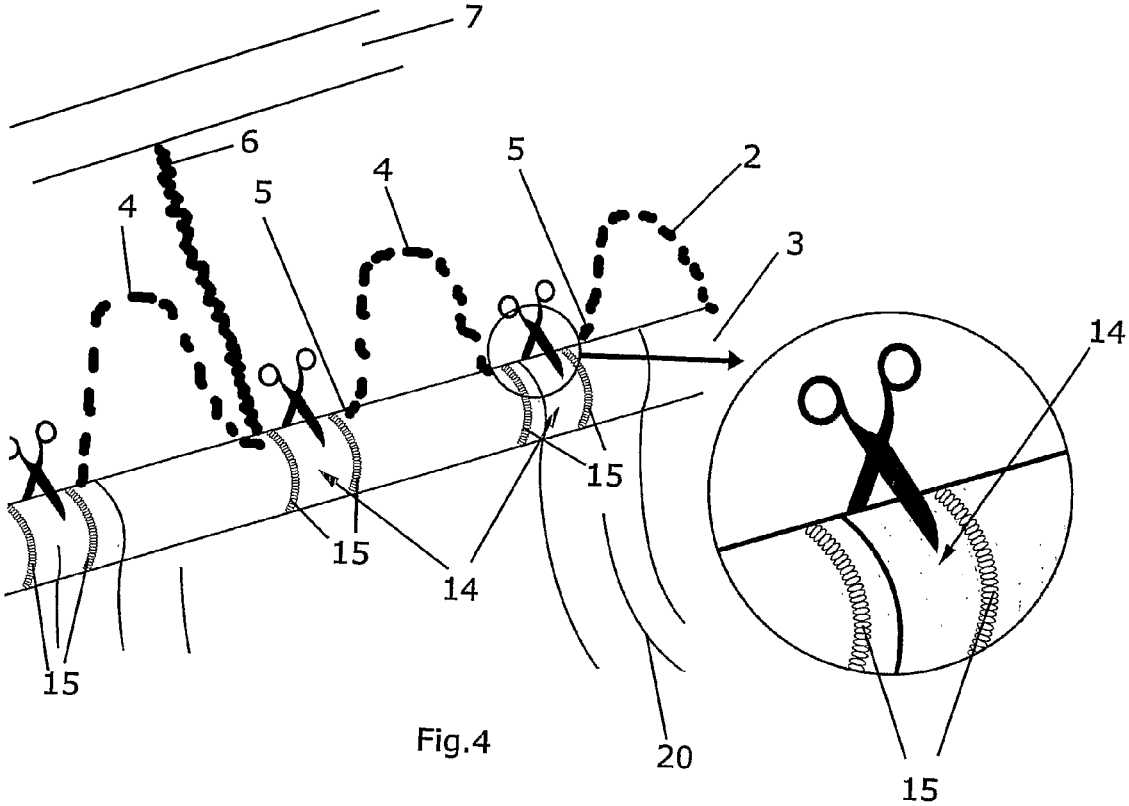
FIG. 4 shows in detail a view of the hair piece provided with dividing zones configuring elements.

FIG. 4 shows in detail a preferred embodiment of a weaving band of the hair piece according to the invention whereby the first 2 and/or the second 3 and/or the third weaving band 7 at regular distance is/are provided with dividing zones 14 configured by e.g. stitched seams or knot elements 15 so that the hair piece may be easily shortened and be made suitable for the hair(do) wherein it must be attached.

By cutting the weaving band within the dividing zone 14 between stitching seams 15 the new outer ends within the dividing zones 14 will not fray, hang open or have an otherwise anaesthetic appearance. Preferably the dividing zones 14 are provided in the third weaving band 3 neighbouring the band troughs 5 of the first weaving band 2, so that after being cut open the adjacent loop with band crest 4 of the wave-form weaving band 2 will not hang loose. If desired the first weaving band 2 may also be provided with stitching forming the dividing zones there between. When the hair piece is provided with a second hair bundle connected to a third weaving band 7 the connection elements 6 are preferably positioned upon the second weaving band in the vicinity of a stitched seam of a dividing zone 14, so that as a result of cutting open the third weaving band 7 its outer end remains connected with the first and/or the second weaving band 2, 3.

Other equivalent measures, known to a men skilled in the art, for configuring a hair piece provided with a waving weaving band are considered to be included within the scope of the herewith described invention.

The invention claimed is:

1. A hair piece for connection with a user's natural hair comprising:

a plurality of hair bundles each comprising a number of parallelly oriented hairs, the hair bundles having a distal end and a proximal end;

a first wave-form weaving band comprising a zigzag, staggered running wave-form comprising band crests and band troughs, the first wave-form weaving band having a plurality of weaving elements disposed thereon; wherein the proximal ends of the hair bundles are connected to the plurality of weaving elements forming a waving hairline at the distal end of the hair bundles, and wherein the first wave-form weaving band is further provided with two support elements, where one of the support element extends linearly, in a longitudinal direction, along the band troughs and another support element extends linearly, in a longitudinal direction, along the band crests where the respective support elements are coupled to the first wave-form weaving band at the band troughs and band crests to maintain the wave-form of the first wave-form weaving band and where the support elements are positioned under at least a portion of the user's hair when in use forming a substantially straight part in the user's hair.

2. A hair piece according to claim 1, wherein the support elements extending along the band troughs form a second weaving band.

3. A hair piece according to claim 1, wherein in use in the user's natural hairs, the band crests of the first wave-form weaving band are tilted in the direction of the user's natural hair.

4. A hair piece according to claim 2, wherein the second weaving band has hairs connected thereto.

5. A hair piece according to claim 1, wherein the hair piece is provided with a mounting means.

6. A hair piece according to claim 5, wherein the mounting means are provided upon the support elements extending along the band troughs.

7. A hair piece according to claim 6, wherein the mounting means are selected from the group consisting of a hair clip, a hair pin, a hair clamp, and an adhesion piece.

8. A hair piece according to claim 1, wherein the first wave-form weaving band is made from hair.

9. A hair piece according to claim 1, wherein the first wave-form weaving band is made from cotton.

10. A hair piece according to claim 1, wherein the first wave-form weaving band is made from a flexible thread material.

* * * * *